US007628610B2

(12) United States Patent
Gehring et al.

(10) Patent No.: US 7,628,610 B2
(45) Date of Patent: Dec. 8, 2009

(54) CONICAL CYCLONIC OXIDIZING BURNER

(75) Inventors: Michael W. Gehring, Bakersfield, CA (US); Juan Antonio Caballero, Brownsville, TX (US); James Sipprelle, Signal Hill, CA (US); William Sweet, Bakersfield, CA (US)

(73) Assignee: Simeken, Inc., Signal Hill, CA (US)

( * ) Notice: Subject to any disclaimer, the term of this patent is extended or adjusted under 35 U.S.C. 154(b) by 449 days.

(21) Appl. No.: 11/415,297

(22) Filed: May 1, 2006

(65) Prior Publication Data

US 2007/0254254 A1 Nov. 1, 2007

(51) Int. Cl.
*F23G 7/06* (2006.01)

(52) U.S. Cl. ..... 431/352; 431/5; 431/170; 110/213

(58) Field of Classification Search ..... 431/5, 431/8–10, 170, 350, 353; 110/210–214
See application file for complete search history.

(56) References Cited

U.S. PATENT DOCUMENTS 1,020,048 A * 3/1912 Normand ..... 431/183
1,126,654 A * 1/1915 Peabody ..... 431/183
2,879,862 A * 3/1959 Burden, Jr. ..... 422/172
3,567,399 A * 3/1971 Altmann et al. ..... 422/183
3,694,135 A * 9/1972 Dancy et al. ..... 431/265
3,850,581 A * 11/1974 Hills et al. ..... 422/176
3,885,919 A * 5/1975 Pillard ..... 422/111
3,893,810 A * 7/1975 Lientz ..... 422/111
4,345,529 A * 8/1982 Weber et al. ..... 110/213
4,351,251 A * 9/1982 Brashears ..... 110/261
4,379,433 A * 4/1983 Hoskinson ..... 110/214
4,622,007 A * 11/1986 Gitman ..... 432/13
5,284,438 A * 2/1994 McGill et al. ..... 431/9
5,366,699 A * 11/1994 Milfeld et al. ..... 422/169
6,012,917 A * 1/2000 Wiseman ..... 431/202
6,168,422 B1 * 1/2001 Motyka et al. ..... 431/202
6,269,755 B1 * 8/2001 Boswell et al. ..... 110/264
6,363,868 B1 * 4/2002 Boswell et al. ..... 110/213
6,494,710 B2 * 12/2002 Kim et al. ..... 431/202

* cited by examiner

*Primary Examiner*—Carl D Price
(74) *Attorney, Agent, or Firm*—Fulwider Patton LLP

(57) ABSTRACT

A method and device for improved efficiency in thermal oxidation is presented which uses a cyclonic flame to combust a stream of hydrocarbons drawn to the flame source by a pressure differential. The improved burner and method are particularly suited for combusting volatile organic compounds that are a derivative result of another waste management process mechanically attached to a thermal oxidizer. The improved burner is formed by configuring a burner basket into a conical shape with openings that allow a combustible gas to travel along the interior of the basket frame. The gas travels spirally within the basket frame as it is assisted by forced air and when ignited, creates a cyclonic flame effectively combusting material such as volatile organic compounds that are manipulated into contacting the flame.

5 Claims, 4 Drawing Sheets

CONICAL CYCLONIC OXIDIZING BURNER

BACKGROUND OF THE INVENTION

1. Field of the Invention

The present invention relates to the field of thermal oxidation burners.

2. Description of the Prior Art

The disposing of certain types of materials by means of burning or incineration has developed into a necessary aspect of waste management. While most waste was simply placed into the earth, this practice has proved to be detrimental to the environment. Pooled waste products often formed toxic byproducts and/or surfaced undesirably above ground at a later date. While solid compositions are routinely disposed of, their decomposition, either naturally or through a waste processing system, often creates other undesirable byproducts that themselves require subsequent management or treatment. One category of byproduct compositions requiring alternative waste management techniques are Volatile Organic Compounds, (VOCs).

Volatile Organic Compounds are organic chemical compounds that have vapour pressures under normal conditions high enough to significantly vaporize and enter the atmosphere. A wide range of carbon-based molecules, such as aldehydes, ketones, and hydrocarbons are VOC's. Common artificial sources of VOCs include petroleum byproducts, paint thinners, and dry cleaning solvents. Additionally, VOCs may be generated in the context of the disposal of carbon based materials or products such as used tires.

VOCs can be undesirable when released into the environment where they can become soil and groundwater contaminants. Also, VOCs escaping into the air contribute to air pollution. For example, methane is one greenhouse gas which may contribute to enhanced global warming. Other VOCs such as benzene are suspected to contribute to cancer through prolonged exposure and are toxic when inhaled. Other VOCs react with nitrogen oxides in the air in the presence of sunlight to form ozone. Ozone is known to pose a health threat by causing respiratory problems and high concentrations of low level atmospheric ozone can damage crops.

In response to the need for effectively disposing of VOCs before they escape into the atmosphere, waste managers turned to the art of thermal oxidation to break down material into manageable compounds or be converted into heat energy. Thermal oxidation is a method of pollution control that can be applied to incineration for air polluted with small particles or combustible solids or liquids. By thermally oxidizing material such as VOCs, molecular bonds break free of each other and reform into inert or useful by products. Often, the efficiency of decomposing VOCs will depend on the efficiency of the flame burning the material. Efficiency in burning depends largely on the temperature of the flame, the turbulence of the system which determines how much fluid movement exists for oxidizing VOCs, and the retention time in exposing material to the flame.

Until now, the prior art in thermal oxidation depended largely on using a singular flame source or singular ring of flames. However, these prior burner designs suffer from various inefficiencies. The VOCs passing through the burner receive limited exposure to the actual flame or combustion area thus not permitting sufficient flame contact for complete burning. The VOCs also do not effectively mix with the ambient oxygen to oxidize effectively for a clean burn. What occurs is relatively "dirty" burning where a significant amount of underburned VOCs remain present.

Other efforts to improve the thermal oxidation of VOCs have focused on increasing the flame temperature itself. Typical flame temperatures in the prior art range between 1000° F. to 1800° F. While effective in one sense, such a strategy suffers from mechanical drawbacks when using a singular flame source. Certain VOCs require more than just increased temperature to effectively decompose. Without the proper oxidizing mix, the VOCs will ineffectively break apart and reform into similar molecules or worse, escape back into the atmosphere. These prior efforts produced partially combusted compounds that were still harmful to the environment. Also, using fuel sources sufficient to increase the flame temperature to a more effective level and render the process economically unviable.

Thus a need exists in the marketplace for an improved burner capable of efficiently decomposing compounds. Aspects of the present invention fulfill this need.

SUMMARY OF THE INVENTION

Briefly and in general terms, the present invention is directed to a burner basket that produces a cyclonic flame. The burner basket is constructed with a conically shaped frame with a plurality of openings and corresponding burner tabs arranged in rings about its inner circumference. A fluid flow of combustible gas may be manipulated to follow a path dictated by the shape of a burner basket and the placement of the tabs. A nozzle is positioned to direct a flow of VOCs to enter the interior of the burner basket. Ambient air is introduced into the system and may be blown in a direction perpendicular to the longitudinal axis of the burner and commences to circulate about the circumference of the basket entering the burner through openings created by formation of the basket burner tabs. An ignition source ignites the gas mixed with the air whereby the basket capitalizes on the directional properties of a conically shaped frame directing the mix in a spiraling path creating a cyclonic combustible emission. The VOCs enter into the basket combusting upon contact with the emission.

To provide support for the basket, a rigid, flammability resistant material such as metal is formed into frustoconical configuration. Tabs are formed by slicing sections of the surface from the metallic frame opening and depressing the sections inwardly within the interior of the basket creating a gap between the tab wall and opening exposing the interior of the basket to the exterior. The tabs may be arranged in rings or in a spiraling sequence about the perimeter of the frame. The smaller diameter end of the basket is extended for receipt of the nozzle.

The nozzle may also be formed from a substantially impermeable, rigid high flammability resistant material. One end of the nozzle is configured to be receivable within the basket while the other end connects to a source of VOC flow. The interior of the nozzle may be constructed to permit relatively unobstructed fluid flow to the interior of the basket.

One preferred embodiment using the burner basket would encompass using the cyclonic burner basket in a thermal oxidizing apparatus where the burner is situated within a chamber. A premix of oxygenated enriched air may be added just previous to combustion to induce efficient burning of the VOCs when the air is ignited. A combustible gas stream is projected into the nozzle and circulates within the basket.

Various methods are available to assist the direction of the combustible gas flow. In one embodiment, a gross control air blower may be configured exterior to the chamber housing the basket having an access to the interior of the chamber providing airflow to travel around the burner basket circumference.

An ignition source ignites the air flow as it flows around the basket and through the burner tabs. When air passes through an ignition zone, flames are produced within the basket frame through the directional tabs creating a cyclonic thermal trail. The hydrocarbon gas of VOCs passing through the center of the basket will engage the flame as the hydrocarbons circulate spirally toward the larger diameter end of the basket.

Those skilled in the art will appreciate that the cyclonic flame produced increases retention time of the flame, turbulence, and temperature of the system. Thus, an improved flame is created for a mechanically and cost efficient means of burning material.

Other features and advantages of the invention will become apparent from the following detailed description, taken in conjunction with the accompanying drawings which illustrate, by way of example, the features of the invention

DETAILED DESCRIPTION OF THE PREFERRED EMBODIMENTS

Figure 1:
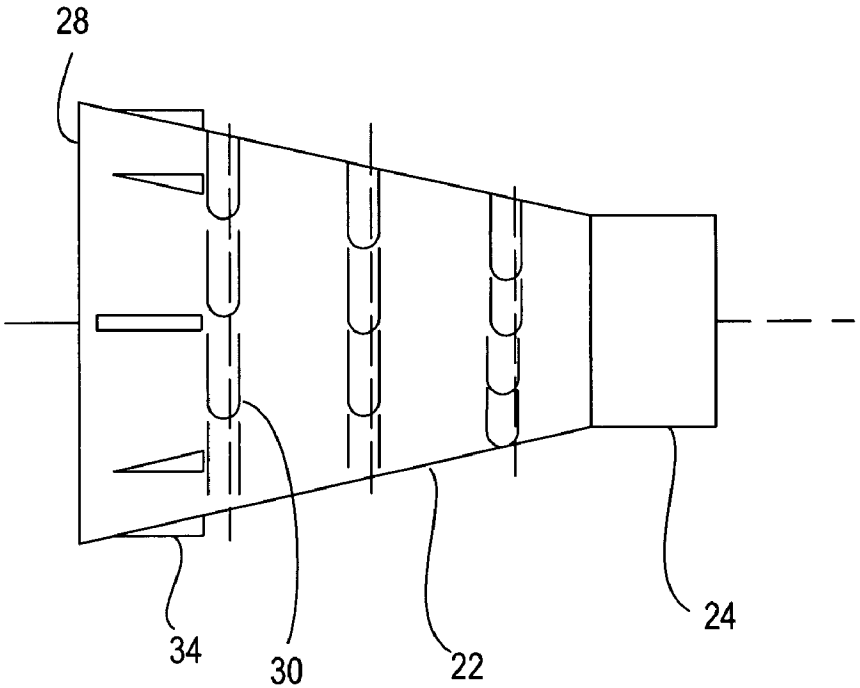
FIG. 1 is a side view of the burner basket of the present invention.
Figure 1A:
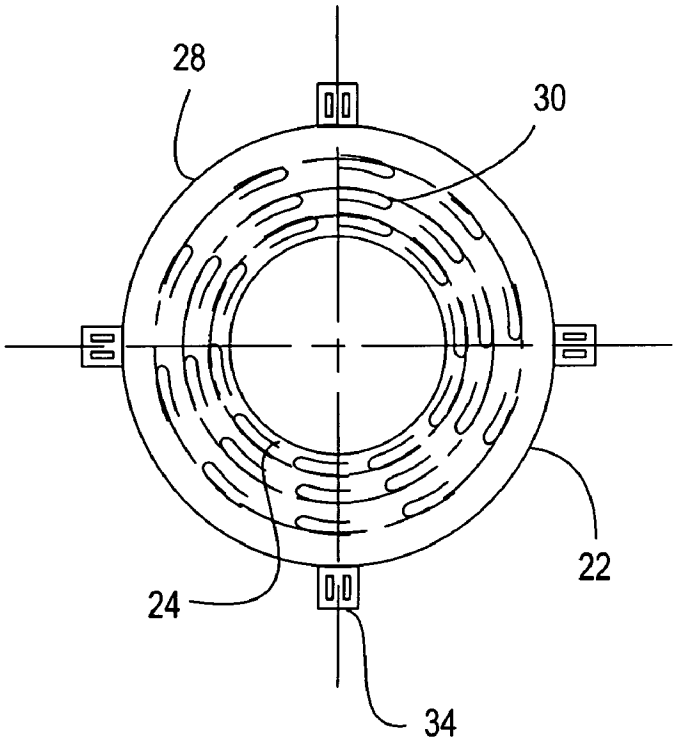
FIG. 1A is an end view of the burner basket show in FIG. 1.
Figure 2:
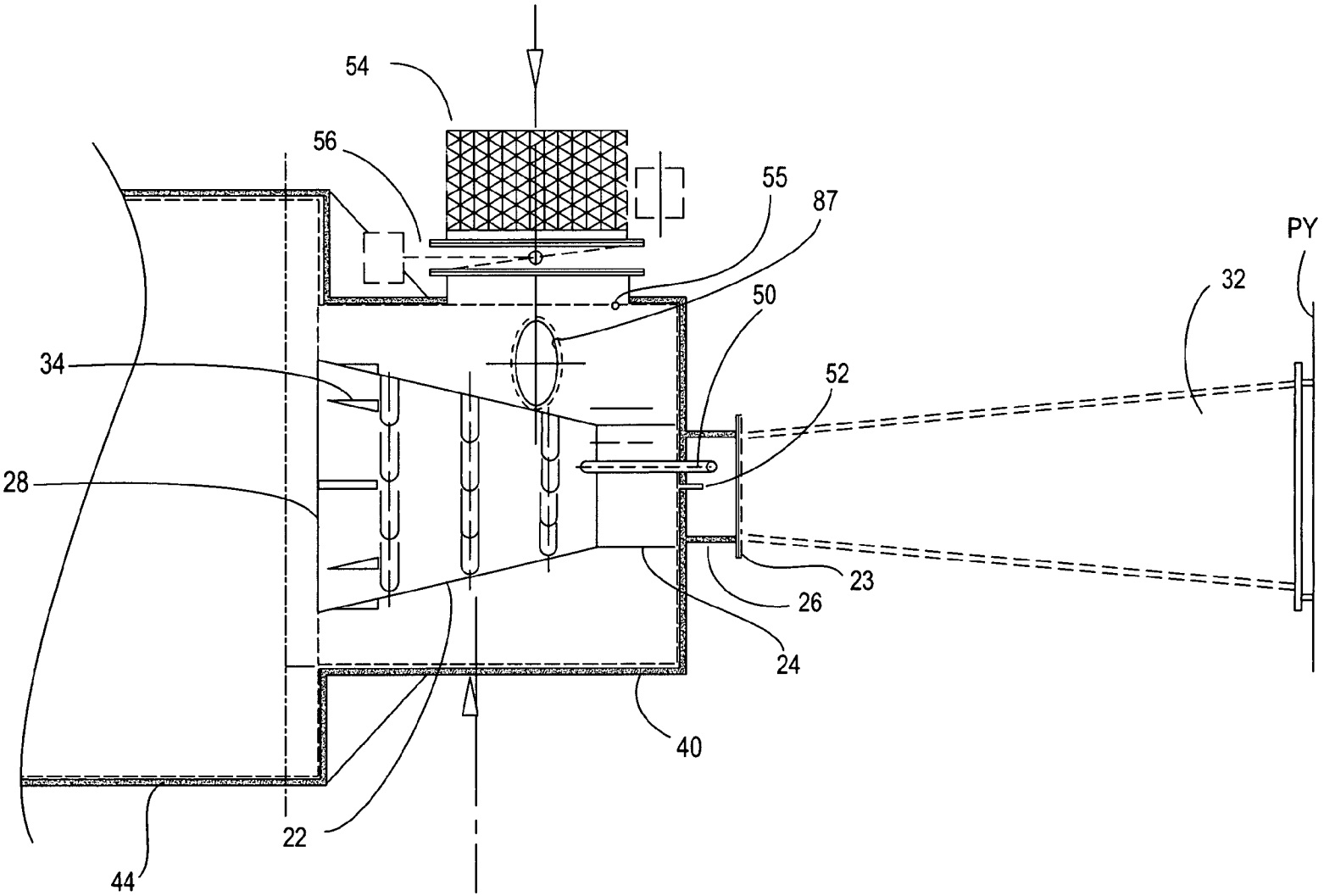
FIG. 2 is a top view, in reduced scale of the burner basket shown in FIG. 1 mounted within an oxidation chamber.

Referring to FIGS. 1, 1A and 2, the thermal oxidizer of the present invention may be configured with a burner basket 22 mounted in an oxidation chamber 40 and attached to a nozzle 26. The oxidation chamber may incorporate a gross air control 54, a fine air control 80, and a premix air valve 50 where necessary (FIG. 4).

The burner basket 22 is configured with a frustoconical frame whose larger diameter base end 28 is opposed by a smaller diameter entrance end with an extended projection 24. In a preferred embodiment, the basket is formed from stainless steel. The frame incorporates within its surface multiple rings of openings concentrically aligned along the perimeter of the frame surface. Burner tabs 30 extend inwardly from each of the openings. The tabs are typically formed in rings parallel to the ends of the basket frame but may be adjusted to form rings that are angled to the basket ends or arranged in a spiral path down the length of the frame. The base end 28 may be configured with mounting flanges 34.

Figure 3:
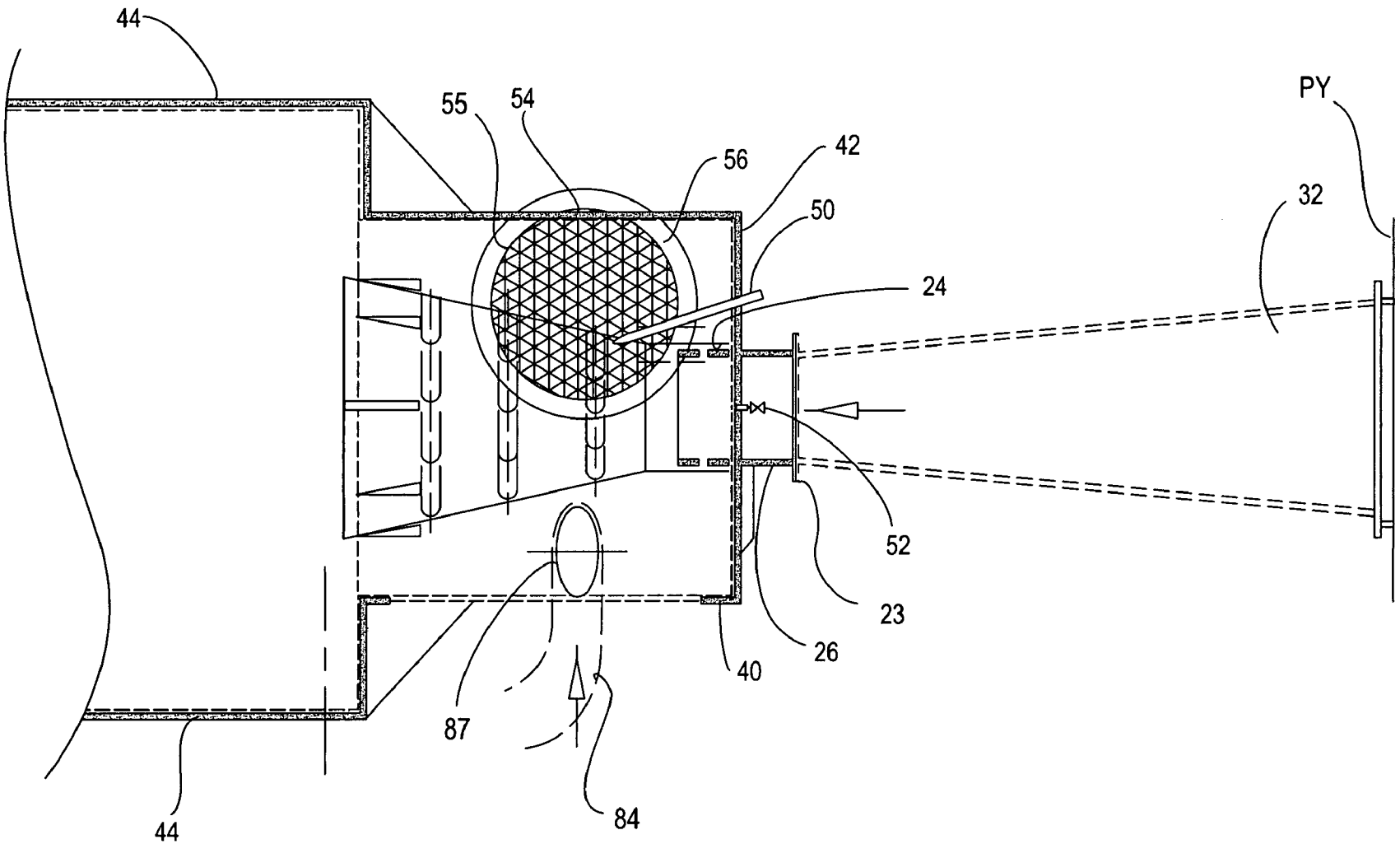
FIG. 3 is a side view of the basket and chamber shown in FIG. 2.

In an embodiment using the burner basket in a thermal oxidizer, an oxidation chamber 40 is provided in connection with a pyrolysis unit PY. Referring to FIGS. 2 and 3, the chamber may be configured with an opening for receipt of a nozzle 26 therethrough and openings 55 and 87 for entry of a fluid from the gross air control 54 and fine air control 80 respectively. The burner basket 22 is positioned longitudinally parallel to the interior side walls of the chamber near the chamber's center line where the projection 24 attaches to the nozzle on one end and the base end 28 is anchored to a platform 44 by mounting flanges 34. The nozzle 26 is connected to the pyrolysis burner by means of a pipe 32 that originates from the pyrolysis unit. A pressure/vacuum pump is provided for reducing the air pressure within the chamber 40.

Figure 4:
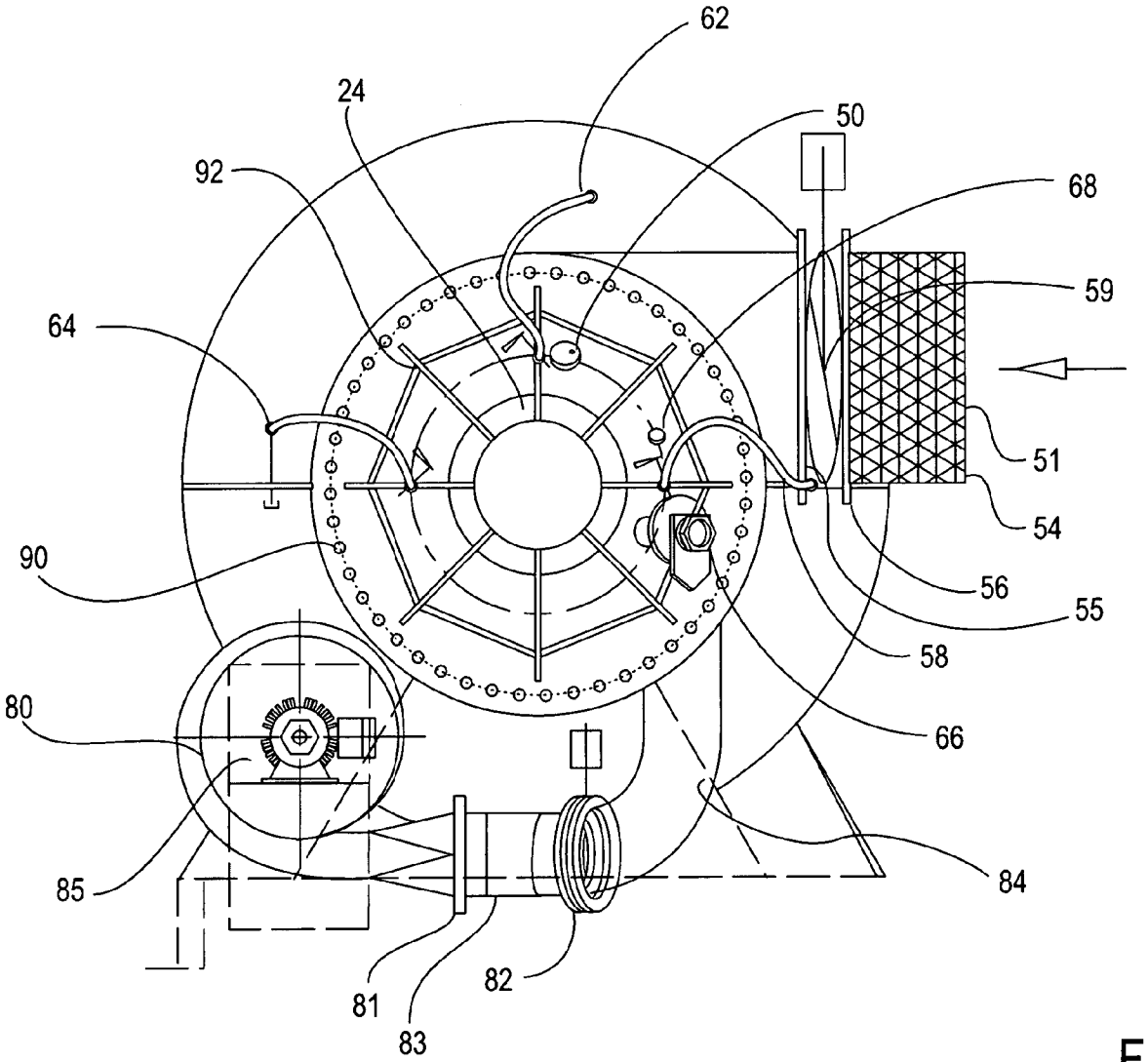
FIG. 4 is a front view of the basket and chamber shown in FIG. 2.

As shown in FIG. 4, the gross air control 54 and fine air control 80 are configured outside the chamber 40 to guide and regulate air volume to the chamber interior. The openings 55 and 87 may be configured perpendicularly to the burner frame 22 permitting air flow to likewise engage perpendicularly and circumferentially about the frame. The gross and fine air controls each incorporate fan sources 56 and 85 respectively regulated by control points 59 and 82 respectively. The gross air control further includes a protective screen 51 that projects externally into the atmosphere outside the pressure differential setting.

Also referring to FIG. 4, the exterior of the chamber 40 may be protected by a covering face 92 that resembles a spider web network of framing when viewed on its end. The cover face may be secured to the chamber face exterior 42 (FIG. 3) by a series of bolting flanges 90 that surround the cover face perimeter. The chamber interior may utilize hoses 58, 62, and 64 as a fuel source carrying means for bringing fuel into the chamber from a fuel tank outside of the chamber. The cover face may also include an oxygen enriched air premix valve 50 projecting through the covering into the chamber where one end may be in close proximity to the first ring of openings and burner tabs 30 or access the interior of the burner basket. A view port 66 may also be incorporated to the face cover providing an observation point to the activity within the chamber.

In operation, hydrocarbon gas containing volatile organic compounds flows toward the lower pressure vacuum setting of the thermal oxidizer through the pipe 32 and is introduced into the oxidizing chamber 40 through the nozzle 26 where VOCs will pass directly into the burner basket 22. A pressure/vacuum pump (not shown) or similar device assists in creating a pressure differential between the interior of thermal oxidizer 40 and the pyrolytic system and assists in drawing the hydrocarbon gas with VOCs toward the chamber. Preferably, the burner basket and nozzle are composed of highly flame resistant and resilient material such as stainless steel. A combustible fluid, such as propane, is typically omnipresent within the basket interior fed in through hoses 58, 62, 64. The gross control 54 and fine control 80 may force air or more combustible fluid, preferably propane, as needed into the chamber so that the air travels perpendicularly to the frame structure of the burner. The gross control 54 functions primarily to force the ambient air against the burner basket frame but may also assist in creating the rough measure of air mixture present in the system. The fine air control 80 is typically utilized to fine tune the air mixture. The fan source 85 associated with fine air control 80 may be used at start up in instances where the pressure difference in the system is insufficient for proper mixing of the air for ignition. As the density of the VOCs change during combustion, the temperature within the chamber will change requiring an adjustment in the amount of air added to the air mixture for efficient oxidation. The need to adjust the air mixture may be monitored by observing the shape and color of the flame through the view port 66.

In one embodiment, multiple rings of burner tabs 30 are formed by cutting the frame in the patterns shown in FIG. 2 and then pushing the frame metal into and around the burner basket 22 forming tabs 30 and their associated openings. Ambient air flow will first pass around the circumference of the burner basket and then enter into the interior of the basket through openings created by the formation of the tabs, wherein the airflow will mix with a combustible gas such as propane pumped into the chamber through hoses 58, 62, and 64. As air passes around the outer circumference of the basket, it must pass through the burner tab openings and at least once around the inner circumference of the basket where it mixes with combustible gas and passes an ignition source that ignites the combustion mixture. Those skilled in the art will appreciate that by forming the basket conically in combination with the rings of tab openings, fluid dynamics dictates that the airflow within the frame will travel spirally downward from the smaller circumference where there is higher air pressure to the lower pressure associated with air traveling around a greater circumference. As the mixed air is ignited near the small end of the basket, further flame fuel such as propane, is introduced into the chamber interior through the hoses and blown toward the basket by gross control 54 and fine air control 80 and through the burner tab rings along the successively larger diameter portions of the basket. The ignited air will follow the spiral flow of air passing through the burner tabs and a cyclonic flame will result. Likewise, those skilled will realize it may be possible to achieve the same spiraling effect by alternate arrangements of openings in the frame so long as the combustible gas is forced down along the basket interior wall.

VOCs are introduced to the interior of the basket after ignition has occurred and the temperature within the basket has reached a sufficient threshold for oxidation, typically greater than 1400° F. As the VOCs enter the basket interior, they will contact the spiral flame as the VOCs and flame concurrently travel down the length of the basket. Those VOCs that pass through the basket interior without mixing will instead encounter the air outside the basket and be blown back around the basket frame and in through the tabs again and down the interior of the basket. The initial ignition of the propane and air mixture may be performed by any practical method such as using a predisposed flint strike or piezoelectric crystal or as simple as inserting an external flame or sparker rod in through the opening 55 towards the basket. The resulting products are then converted into other compounds such as carbon dioxide and water.

Those skilled in the art will appreciate that the size of the basket, the directional tabs, and the air/gas flows are correlated to the volume of VOCs desired for oxidizing. One preferred embodiment uses a frame volume whose length is 4 feet 1 inch long coupled to an additional 12 inch long projection for receiving the nozzle and has a rear base 3 feet 5 inches wide in circumference with a nozzle base 1 foot 9 inches wide circumferentially. An example of a VOC composition resulting from the incineration of rubber tires that may be combusted using this burner basket design is illustrated in the following table:

| Components | Mole % (Approximation) | Wt % (Approximation) |
|---|---|---|
| | Gas (total 56%) | |
| Hydrogen | 8.7 | 0.3 |
| Water | 4.1 | 1.5 |
| Carbon Dioxide | 5.6 | 1.7 |
| Carbon Monoxide | 4.7 | 2.6 |
| Nitrogen | 24.5 | 13.7 |
| Methane | 10.6 | 3.4 |
| Ethane/Ethylene | 5.0 | 3.3 |
| Butane | 9.4 | 10.9 |
| | Light oils (total 38%) | |
| Benzene | 3.8 | 5.8 |
| Toluene | 3.1 | 5.7 |
| Ethyl Benzene | 2.5 | 5.3 |
| Xylene | 2.5 | 5.3 |
| Styrene | 3.1 | 6.5 |
| C10H16 (Limonene) | 3.1 | 8.5 |
| Misc. | 5.6 | 12.0 |
| | Heavy oils (total 6%) | |
| Misc. | 3.8 | 13.5 |

VOCs with higher molecular weight may require a different ratio of basket area to air volume than the exemplary one described to completely combust.

In some instances, increasing the efficiency of oxidizing where the VOCs are particularly dense can be augmented by introducing a premix of oxygen into the basket interior via air valve 50. In other cases, some VOCs will be self combustible without any other combustible gases present necessary for efficient oxidation. In these cases, ambient air can be blown into the chamber for the purpose of manipulating gas flow into the basket to assist in spiraling the airflow down the frame as it burns. Those skilled in the art will also recognize that the flow of combustible gas may, in an alternative design, be forced into the interior of the basket from one of the ends to escape spirally out through the tab openings and the VOCs may be combusted by being forced into contact with the flame that results from burning the air mixture as it escapes to the exterior of the basket burner.

It will be appreciated by those skilled in the art that the cyclonic flame created by the burner may be effective in several applications where efficient burning is desirable. While thermal oxidation systems are one readily known application, any application that would benefit from an efficient flame can use a conically shaped burner basket. By adjusting the size of the burner basket, the amount of air/gas flow, the positioning of air inputs, the direction and amount of the burner tabs, the cyclonic property of the evolving flame can be manipulated to produce an effective and efficient burn. Furthermore, at least two rings of burner tabs should formed around the basket, however, for most applications, four rings tends to be most cost effective and efficient. Alternate applications for the cyclonic flame may include for example, environmental heating systems, food preparation apparatuses, torch and welding devices, dryers, and other incinerators.

By creating a cyclonic shape to the flame, we have discovered that turbulence, retention time, and temperature within the burn system is increased resulting in an improved efficient burn. The spiraling behavior of the flame creates increased turbulence in the system by increasing the movement of particles. Those in the art will appreciate that increased movement of the VOCs allows for increased oxidizing properties of the treated material as the VOCs come into increased contact with oxygen particles before passing out of the flame. Likewise, retention time of the particles is increased by virtue of the cyclonic flame effect. Increasing the retention time leads to VOCs or any other treated material to encircle the circumference of the burner more resulting in longer exposure to the burning flame. As a result of these two increased attributes, the overall temperature of the flame and system consequently increases.

As such, it can be seen that by designing a conically shaped burner basket in combination with manipulated gas flow, we have invented a cyclonic flame burner that creates an improved flame for the thermal oxidizing and incineration of material.

We claim:

1. A thermal oxidizing chamber for combustion of fluids, comprising:

a nozzle projecting from a face of the chamber;

a hollow burner basket configured within the chamber interior, the basket, frame configured to receive the nozzle at a first end and mounted to a chamber base at a basket opposite end;

the burner basket formed to circumferentially expand from the first end to the opposite end, the basket further formed with a plurality of openings defined by inwardly extending tabs forward from the basket frame at least one gas source connected to the chamber exterior and configured for injecting a gas into contact with and perpendicular to the basket; and;

a valve formed on the face of the chamber configured to receive a premixture of air and provide the premixture to the chamber interior.

2. The chamber of claim 1, wherein:

the openings are arranged in at least two concentric rings around the perimeter of the basket frame.

3. The chamber of claim 1 further comprising:

a gas source control configured between the gas source and the chamber interior and operable to regulate a flow of gas therein.

4. A thermal oxidizing chamber for combustion of fluids, comprising:

a nozzle projecting from a face of the chamber;

a hollow burner basket frame configured within the chamber interior, the basket configured to receive the nozzle at a first end and mounted to a chamber base at a basket opposite end;

the burner basket formed to circumferentially expand from the first end to the opposite end, the basket further formed with a plurality of openings defined by inwardly extending tabs forward from the basket frame;

at least one gas source connected to the chamber exterior and configured for injecting a gas into contact with and perpendicular to the basket;

two gas sources wherein one gas source is a gross air control configured to administer a rough measure of gas into the chamber and the other gas source is a fine air control configured to fine tune an air mixture within the chamber; and:

the gross air control is configured surrounded by a protective screen.

5. The chamber of claim 1 wherein:

the basket and nozzle are constructed from stainless steel.

* * * * *